US005385452A

United States Patent [19]

Lyday

[11] Patent Number: 5,385,452

[45] Date of Patent: Jan. 31, 1995

[54] HYDRAULIC FLUID PRESSURIZER WITH FLUID CUSHIONING MEANS

[75] Inventor: Joe H. Lyday, Beaumont, Tex.

[73] Assignee: Active Management, Inc., Beaumont, Tex.

[21] Appl. No.: 986,273

[22] Filed: Dec. 7, 1992

[51] Int. Cl.[6] ..... F04B 35/00; F01B 11/02

[52] U.S. Cl. ..... 417/403; 91/4 R; 92/85 R; 417/426; 417/53

[58] Field of Search ..... 417/53, 569, 382, 383, 417/384, 385, 387, 398, 426, 399, 401, 403; 91/4 R; 92/85 R, 85 A, 85 B

[56] References Cited

U.S. PATENT DOCUMENTS

| | | | |
|---|---|---|---|
| 1,338,379 | 4/1920 | Leach | 92/85 A |
| 2,293,076 | 8/1942 | Ponting . | |
| 2,336,446 | 12/1943 | Tucker et al. . | |
| 2,532,679 | 12/1950 | Slater . | |
| 2,579,670 | 2/1951 | Hjarpe . | |
| 2,979,903 | 4/1961 | Beck | 91/4 |
| 3,077,838 | 2/1963 | Maglott | 417/397 |
| 3,086,423 | 4/1963 | Chamberlin | 91/4 |
| 3,306,042 | 2/1967 | Crooks | 417/387 |
| 3,520,477 | 7/1970 | Cooley | 417/401 |
| 3,771,912 | 11/1973 | Conlee | 417/397 |
| 3,995,974 | 12/1976 | Herron | 417/398 |
| 4,659,294 | 4/1987 | Barthomeuf . | |
| 4,747,758 | 5/1988 | Saurwein . | |
| 4,971,531 | 11/1990 | Aikioniemi | 417/401 |
| 5,042,253 | 8/1991 | Kataoka | 91/4 R |
| 5,092,744 | 3/1992 | Bores et al. | 417/569 |
| 5,140,894 | 8/1992 | Snyder et al. | 91/4 R |

FOREIGN PATENT DOCUMENTS

| | | | |
|---|---|---|---|
| 8278 | 1/1983 | Japan | 417/401 |
| 3837717 | 5/1990 | Netherlands | 417/403 |
| 2175352 | 11/1986 | United Kingdom | 417/403 |

OTHER PUBLICATIONS

Brochure, Parker Seal Design & Appl., Parker Seal Group, Salt Lake City, Utah, undated.

M. Hashish, Cutting With Abrasive Waterjets, 1984 Mech. Egr. 60.

Exec. Comm. Nat'l Safety Council, High-Pressure Water Blasting, Data Sheet 633, 1971.

L. Frenzel, Evaluation of 20,000 psi Water Jetting for Surface Prep. of Steel Prior to Coating or Recoating, Coastal Sci. Assoc., Kenner. La., undated.

Var. Application Repts., Colt Services, Inc., Pasadena, Tex., undated.

Application Profile: Cleaning Heat Exchangers, Flow Int'l Corp., 1989.

Brochure, Ultrahigh Pressure, ADMAC, Inc., Kent, Wash., undated.

*Primary Examiner*—Richard A. Bertsch
*Assistant Examiner*—Roland G. McAndrews
*Attorney, Agent, or Firm*—Guy V. Manning

[57] ABSTRACT

An improved water pressurizer comprises a pair of piston and plunger type intensifiers each driven by pressurized oil on one side of the piston and returned to the starting position by air pressure on the opposite side of the piston. Magnetic sensing switches detect proximity of the piston as it nears the end of a power or return stroke and send enabling signals to electropneumatic relays controlling air actuated ball valves on input and output oil lines. Because of the displacement volume and piston to plunger ratio, the intensifiers reciprocate at unusually low frequencies, reducing down time for maintenance or repair and thereby increasing reliability and capacity factor. Installed on a trailer for transportation, the apparatus can be attached to any available water supply for providing pressurized working fluid to a remote site.

11 Claims, 7 Drawing Sheets

HYDRAULIC FLUID PRESSURIZER WITH FLUID CUSHIONING MEANS

BACKGROUND OF THE INVENTION

1. Field of the Invention

This invention relates to improvements in fluid pressure intensifiers and, more particularly, to hydraulic systems for boosting water pressure for cutting and cleaning applications.

2. Description of Related Art

At industrial sites such as refineries, shipbuilding and repair operations, need often arises for paint or contaminant removal and for cutting thick plate steel or concrete at remote sites. Conventional cleaning methods include sand and water blasting and metal-to-metal impact or scraping techniques, while cutting may be performed using acetylene torches and jackhammers. Sandblasting creates silicosis hazards for workers as well as environmental pollution, while torches and jackhammers leave jagged holes at best and create hazards to property and safety at times. Particularly where flammable liquids and gasses have been stored, such as in the holds of ships and barges, or in refinery storage tanks many feet in height and diameter, and where container walls may be half (½") inch steel plate or greater, combustion cutting, with acetylene torches or drilling and sawing where sparks are produced, may create hazards to human life and property. Likewise, paint removal and cleaning operations can generate such hazards if conducted using conventional scraping and polishing methods. Consequently, a need exists for a means of conducting non-combustion cleaning and cutting operations in such areas.

Water, with or without sand, is the preferred working fluid for non-combustion cleaning and cutting operations because it is abundant at most industrial sites and because it is relatively low in viscosity and non-flammable even under very high pressures. A number of devices available provide an apparatus for producing thin stream water for cutting, but many do not provide enough power to cut thick steel plate or thick concrete. It has been shown that cutting plate steel comparable to that used for such industrial application as mentioned above requires water pressures in excess of 30,000 pounds per square inch.

Further, those devices available that produce the necessary pressure often employ small piston and plunger type intensifiers that operate at such high frequency, and produce such a small displacement of water, that they require frequent maintenance or become unreliable after only a moderate number of hours of operation. If difficulties arise at remote sites, they often cannot be repaired without returning the device to a repair shop, thus requiring that the cutting operation be suspended until the unit is repaired, or requiring that a backup device be ready for the contingency. Thus, a need exists for a more reliable cutting apparatus which operates at a low enough cycle to minimize repair and maintenance, thereby having a high capacity factor (capacity factor is defined as the percent of time a device actually operates divided by the total time it could be operating if functioning properly at all times).

Often at such industrial sites, sources of power are limited. A device which requires electric power to function must be able to generate its own or it the power must be supplied at the site. In situations such as discussed above, for example, where piping and access doors may be required in an existing tank in a tank farm at a refinery, the work cannot be transported to a stationary site for cutting. Consequently, a need exists for a non-combustion cutting apparatus for such applications which is transportable.

SUMMARY OF THE INVENTION

Accordingly, it is an object of this invention to provide an apparatus which can produce cleaning and cutting operations without causing combustion hazards.

It is another object of this invention to provide a water pressurizer which can produce pressures in excess of thirty thousand pounds per square inch.

It is another object of this invention to provide a water pressurizer of increased reliability.

It is another object of this invention to provide a water pressurizer which operates at a very low reciprocating frequency.

It is yet another object of this invention to provide a largely self-contained and thereby transportable water pressurizer.

The foregoing and other objects of this invention are achieved by providing an improved hydraulic fluid pressurizer comprising a pair of piston and plunger type intensifiers each driven by pressurized oil on one side of the piston and returned to the starting position by air pressure on the opposite side of the piston. Magnetic sensing switches detect proximity of the piston as it nears the end of a power or return stroke and send enabling signals to electropneumatic relays controlling air actuated ball valves on input and output oil lines. Because of the displacement volume and piston to plunger ratio, the intensifiers reciprocate at unusually low frequencies, reducing down time for maintenance or repair and thereby increasing reliability and capacity factor. Installed on a trailer for transportation, the apparatus can be attached to any available water supply for providing pressurized working fluid to a remote site.

BRIEF DESCRIPTION OF THE DRAWINGS

The novel features believed characteristic of the present invention are set forth in the appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 1:
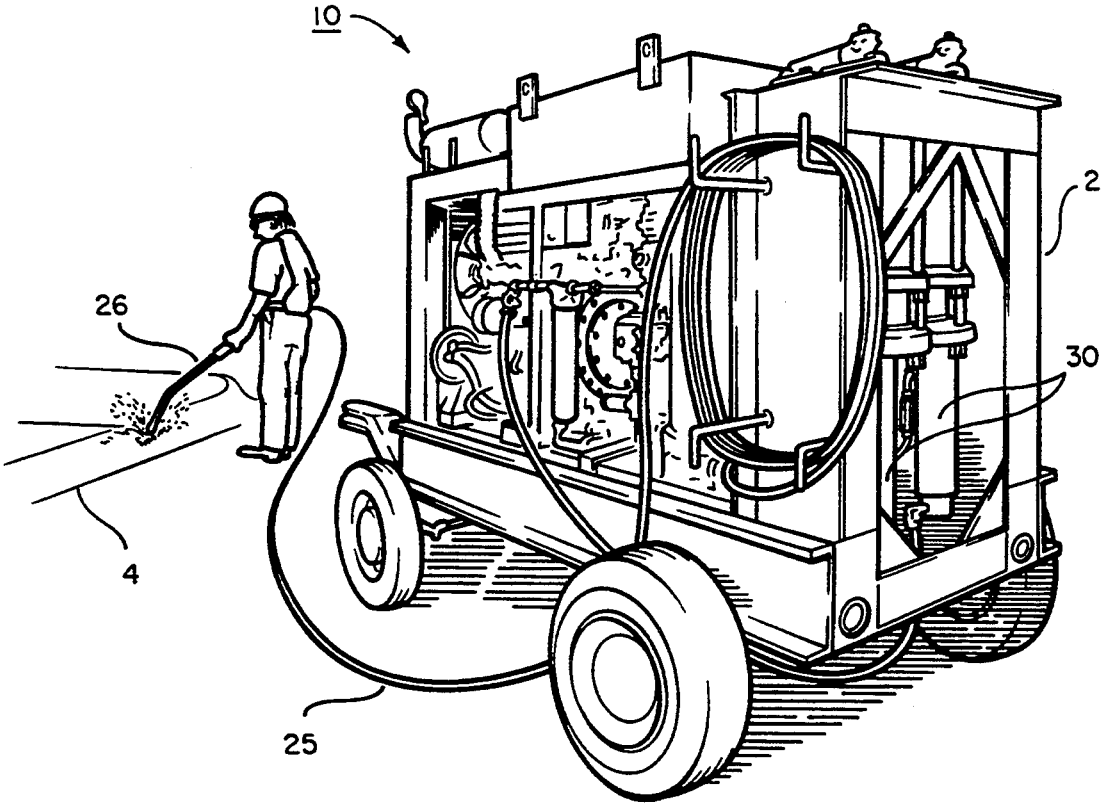
FIG. 1 depicts the water pressurizer of the present invention mounted on a trailer for transportation to a work site.
Figure 2:
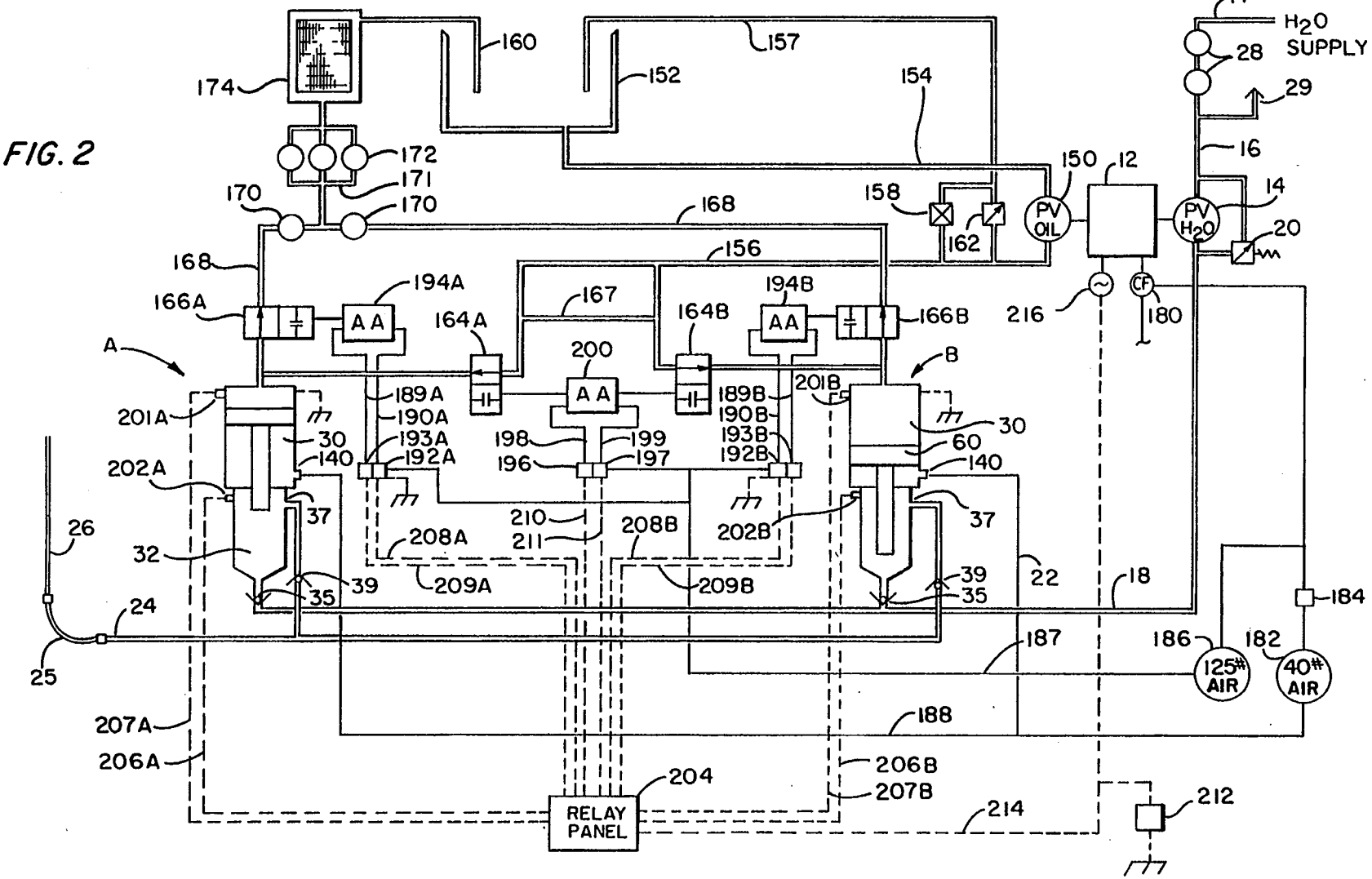
FIG. 2 is a systems diagram of the water pressurizer, depicting supply, control, oil and air systems.

With reference now to the figures, and in particular to FIGS. 1 and 2, fluid pressurizer 10 comprises a pair of intensifiers 30 which operate alternately to step up the pressure of a working fluid in high pressure chamber 32 and to emit the pressurized working fluid into distribution manifold 24 for distribution to work site 4 through distributor 25 (typically a hose) and tool 26. As shown in FIG. 1, the pressurizer system can be mounted on a trailer 2 for transportation to work site 4 within reach of distributor 25 and tool 26.

NOTE: Where the following discussion will be enhanced by doing so, corresponding components of each separate intensifier 30, designated generally as A and B in FIG. 2, will be given a suffix A or B as appropriate.

A prime mover 12 provides power to a driving fluid system which drives intensifiers 30, to a charging system which directs the working fluid into high pressure working chamber 32, to an air system which returns intensifiers 30 to their starting positions after a power stroke, and to an electrical system which controls the other systems. Prime mover 12 is preferably a diesel or gasoline, internal combustion motor having its own fuel reservoir, such as a 210 horsepower, 2200 rpm, 4-stroke, 504.5 cu. in. 6 cylinder engine available as Model 6CT8.3 from Cummins Southern Plains, Inc., of Arlington, Tex. The motor 12 should have a plurality of power takeoff gears for simultaneously providing power to the operating systems. The discussion herein assumes this configuration, but one having ordinary skill in the relevant art will recognize that each system could have its own power source, such as an independent power supply for electric motors driving the pumps or a battery for the control system. Each such alternative source is considered within the scope and spirit of the present invention.

Figure 3:
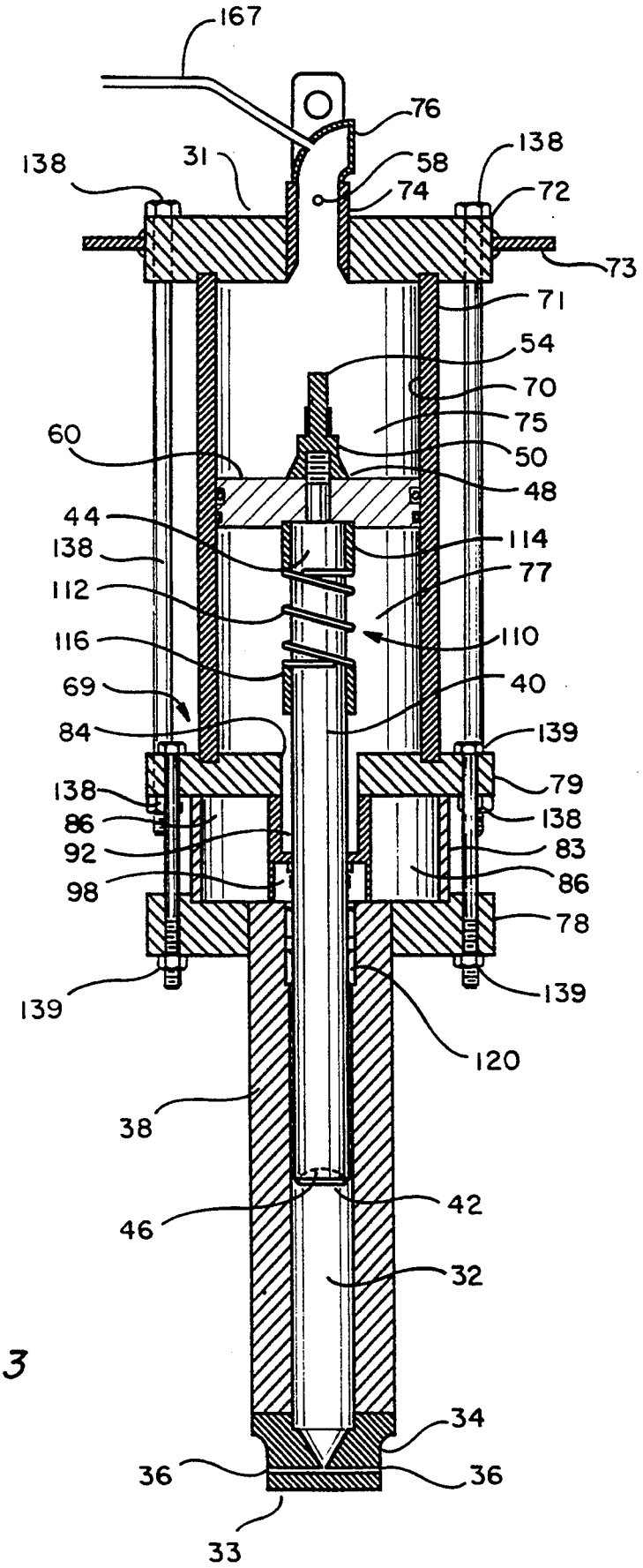
FIG. 3 shows a single intensifier in cross section.
Figure 4:
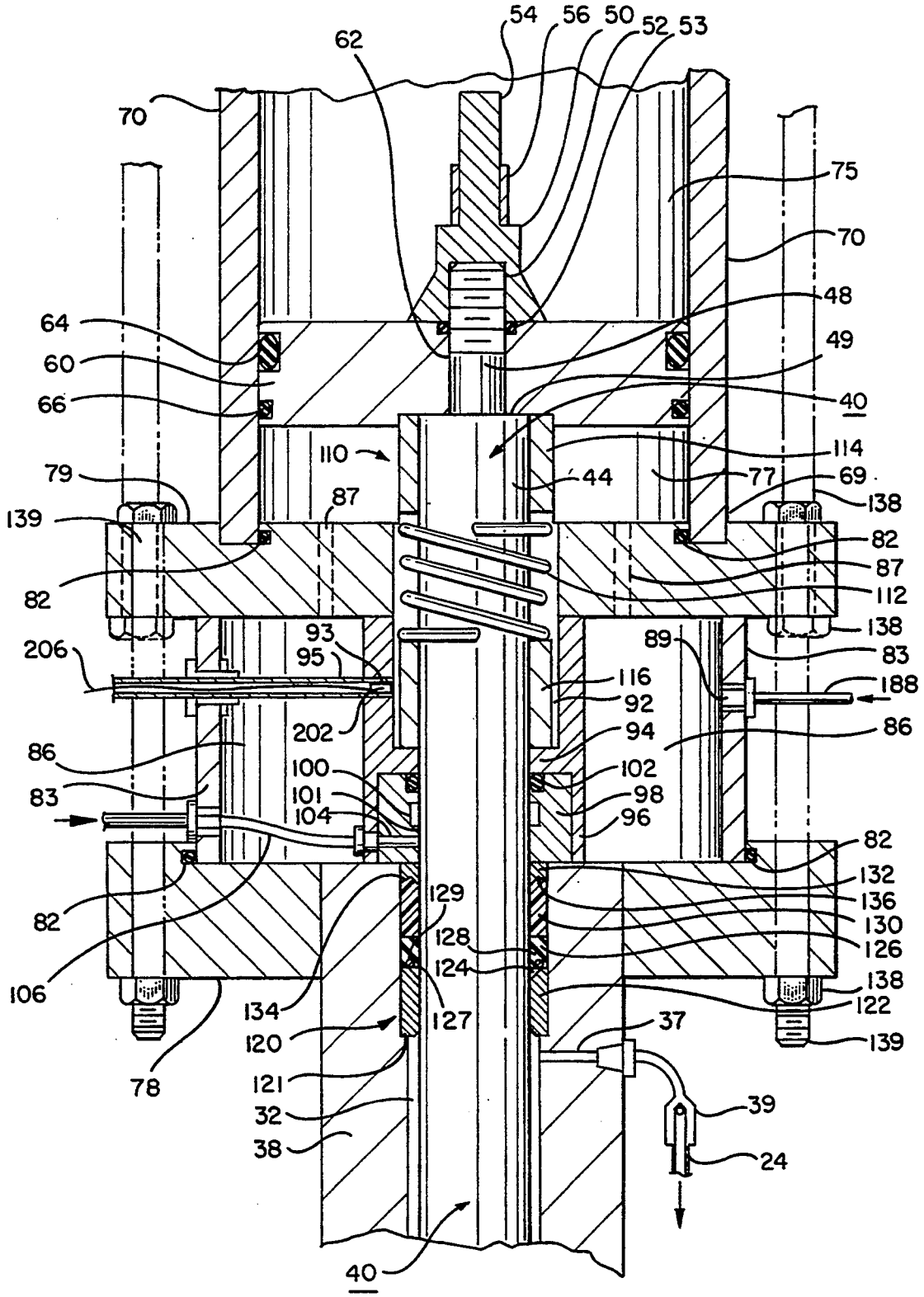
FIG. 4 details the middle section of the intensifier of FIG. 3.

With regard now additionally to FIGS. 3 and 4, each intensifier comprises a cylindrical low pressure chamber 70 coupled coaxially and end to end with a cylindrical high pressure chamber 32. An intermediate chamber 83 separates high pressure chamber 32 and low pressure chamber 70 and contains air chamber 86, spring seat 92 and lubricating manifold 98. A plurality of bolts 138, 139 sandwich portions thereof between flanges 72, 78 and 79. One having ordinary skill in the art will recognize that the bolt configuration depicted could be varied without departing from the scope and spirit of the present invention.

A power stroke is produced by a driving fluid such as oil flowing into the top end 31 of low pressure chamber 70. The driving fluid is preferably standard hydraulic oil pressurized to within the range of 2000 to 4000 pounds per square inch (psi). Pump 150 driven by a power takeoff gear from the main crankshaft of motor 12 pressurizes the oil and forces it through high pressure oil line 156 to each intensifier 30. Reservoir 152 furnishes oil through gravity feed line 154 to pump 150. Pressure relief valve 162 controls pressure in high pressure line 156 and bypass valve 158 permits deactivation of the oil pressure to intensifiers 30 without shutting down motor 12. Pressure relief valve 162 and bypass valve 158 return the oil to reservoir 152 through shunt line 157.

Piston 60 inside low pressure chamber 70 divides it into a driving chamber 75 for the oil at the top end 31 and a return chamber 77 for the return fluid at the bottom end 69 of low pressure chamber 70. The return fluid is preferably air compressed to a pressure range of approximately forty (40) psi. The volumes of driving chamber 75 and return chamber 77 fluctuate as piston 60 reciprocates within low pressure chamber 70 in response to changes in pressure of the oil in driving chamber 75. Oil seal 64 surrounds piston 60 to retain the oil within driving chamber 75, while a separate air seal 66 likewise surrounds piston 60 to maintain air pressure within return chamber 77.

Pressurized oil enters driving chamber 75 through input valve 164 from high pressure line 156. Low pressure effluent oil leaves driving chamber 75 through output valve 166 to enter return line 168 coupled to accumulator 170 serving to absorb any residual pressure impulses. The oil from each intensifier 30 merges in return oil manifold 171 and passes through a plurality of filters 172 and heat exchanger 174 to clean and cool the oil before returning it to reservoir 152.

Plunger 40 coupled to piston 60 extends through lubricating manifold 98 housed in intermediate chamber 83 and into high pressure chamber 32. Plunger 40 comprises a cylindrical shaft having a uniform diameter substantially smaller than the diameter of the piston 60. Concave scallop 46 in pressure end 42 of plunger 40 opposite piston 60 serves to dampen turbulence within the working fluid during a power stroke. Threaded bolt 48 extends from piston end 44 of plunger 40 through aperture 62 through piston 60. Shoulder 49 abuts piston 60 surrounding aperture 62, and endcap 50 having internal threads 52 cooperates with threaded bolt 48 to sandwich piston 60 between shoulder 49 and endcap 50 for securing plunger 40 to piston 60. Pressure end 42 of plunger 40 thereby reciprocates within high pressure chamber 32 in unison with the motion of piston 60. Annular oil seal 53 prevents oil intrusion into return chamber 77 through aperture 62.

An extension 54 rides atop endcap 50, supported by ribs 56. As piston 60 nears the top end 31 of low pressure chamber 70, extension 54 protrudes beyond top flange 72 into an upper seat 74 adapted to receive internally extension 54 and a portion of endcap 50. Housed in the wall of the upper seat 74 is upper magnetic sensing switch 201 cooperating with port 58 adapted to receive it internally and position it near a space periodically occupied by extension 54. As piston 60 nears the end of its return stroke, extension 54 passes near detector 58 of switch 201 mounted within seat 74, causing switch 201 to close and conduct electricity to the chassis ground through the metallic body of intensifier 30. Magnetic sensing switch 201 and detector 58 are preferably integrated as a single pole, double throw, twelve (12 v.) volt dc switch commonly available and capable of withstanding the high pressure and oil environment of seat 74. A suitable switch is Cat. #74-XX available from McMaster-Carr of Chicago, Ill., which model may also serve as switch 202. As discussed more fully below, wire 207 from relay panel 204 provides electricity to switch 201 and transmits the consequent signal to relay panel 204 to control the driving fluid.

Continuing with FIGS. 3 and 4, a cushioning means 110 rides on piston 60 encircling plunger 40. Cushioning means 110 assembly comprises first mounting collar 114 fixed to piston 60, spring 112 fixed to mounting collar 114, and impact collar 116 fixed to spring 112. Impact collar 116 is adapted to be received within seat 92 in intermediate chamber 83 immediately adjacent return chamber 77. Impact collar 116 passes through opening 84 in middle flange 79 to reach seat 92. As piston 60 nears bottom end 69 of low pressure chamber 70, impact collar 116 contacts shelf 94 within seat 92, halting its progress. As piston 60 continues to move toward bottom end 69, spring 112 compresses, as seen in FIG. 4, cushioning and slowing the progress of piston 60 as it nears the end of its power stroke. During the return stroke, cushioning assembly 110 decompresses and hangs extended along and surrounding plunger 40 within return chamber 77, as seen in FIG. 3 until the end of the next power stroke.

A second magnetic sensing switch 202 is installed into a port 93 adapted for the purpose in the wall of seat 92. Conduit 95 carries leads from magnetic switch 202 to exterior intermediate chamber 83, which leads run to relay panel 204. Sensing switch 202 detects arrival of impact collar 116 and closes, thereby sending a detection signal to relay panel 204 to assist in control of the driving system as further discussed below.

Beneath the seat 92 within intermediate chamber 83 is housed lubricating manifold 98 that lubricates plunger 40. Annular lubrication reservoir 100 surrounds passage 101 through manifold 98, through which plunger 40 reaches high pressure chamber 32, to bathe plunger 40 in lubricating oil. Oil duct 104 extends radially from passage 101 to the outer perimeter of lubricating manifold 98 where lubrication access line 106 cooperates with duct 104 to provide access to lubrication reservoir 100 from exterior intermediate chamber 83. Isolation seal 102 prevents intrusion of air into lubrication reservoir 100 from return chamber 77 and wipes excess lubricating oil from the surface of plunger 40.

Annular air chamber 86 surrounds spring seat 92 and lubrication manifold 98 within intermediate chamber 83. A plurality of access holes 87 communicate through middle flange 79 to return chamber 77. An air access port 89 communicates with the exterior of intermediate chamber 83 and cooperates with air line 188 which furnishes air to air chamber 86 from low pressure air tank 182. Compressor 180 driven by a power takeoff of motor 12 provides pressurized air at approximately 125 psi, and pressure reducer 184 steps the pressure down to 40 psi before the air enters air tank 182. High pressure air tank 186 collects additional air at 125 psi for use with the control system discussed below. One having ordinary skill in the art will recognize that these pressures are approximate, that substantial variations of these pressures will work satisfactorily, and that all such pressures are within the spirit and scope of the present invention.

Air chamber 83 and first air tank 182, both charged with 40 psi air, serve dual purposes. The air system comprises the return fluid system that returns piston 60 to the top end 31 of low pressure chamber 70. Further, the air in return chamber 77 provides additional cushioning between piston 60 and bottom end 69 of low pressure chamber 70. As piston 60 progresses through its power stroke, approaching bottom end 69 of low pressure chamber 70, the air is forced out of return chamber 77 into air chamber 86, into low pressure air tank 182, and beyond into air chamber 83 and return chamber 77 of the other intensifier 30 (say 30B). The power stroke of piston 60A thereby serves to assist in returning piston 60B to its beginning position near the top end 31B of low pressure chamber 70B. Because input valve 164B is closed and output valve 166B is open, the oil in driving chamber 75B is no longer under pressure and offers very little resistance to piston 60B in contrast to that met by piston 60A during its power stroke through plunger 40A from high pressure chamber 32A. The time required for the return stroke of piston 60B thus is considerably less than (approximately half) the time consumed by the power stroke of piston 60A. Once piston 60B reaches its beginning position, the total volume of the air system begins to shrink in response to continued progress of piston 60A during its power stroke. This raises the pressure in the air system and particularly in return chamber 77A, thereby slowing piston 60A and cushioning its impact with the bottom end 69A of low pressure chamber 70A. The confined air thus oscillates between return chambers 77 like a seesaw oscillates between riders, serving both as a cushioning means and as a return fluid.

A working fluid enters high pressure chamber 32 through a plurality of check valves 35 immediately exterior inlet cap 34 at inlet end 33 of high pressure chamber 32. The working fluid is preferably water pressurized to approximately 225 psi, but one having ordinary skill in the art will recognize that pressures substantially above and below this pressure will work. Check valves 35 prevent water from exiting high pressure chamber 32 back through inlet cap 34 and into the charging system. The charging system comprises intake 17 coupled to water supply 15. Intake 17 is preferably a hose (not shown) connected to a city or industrial water supply, but any source of abundant water at approximately thirty-two (32) psi will serve the purpose. A plurality of filters 28 assure purity of the water before it passes through low pressure line 16 to water pump 14 which steps up the water pressure to working fluid pressure.

Water pump 14 is driven by motor 12. Water pump 14 forces water through intermediate pressure water line 18 to enter high pressure chamber 32 during the return stroke of piston 60. As plunger 40 withdraws from high pressure chamber 32 during the power stroke, it draws water through input check valve 35 from the water line 18. Output check valve 39 prevents pressurized water from entering through output port 37 from water manifold 24. Thus, water propagates through high pressure chamber 32 with each power stroke and is replaced by fresh water on the return stroke. As one intensifier 30 forces water under high pressure through water manifold 24 and into distributor 25, the other intensifier 30 fills with water and readies itself to take over the pressurizing activity as the first intensifier 30 completes its power stroke. A constant power stroke is thus applied to the water in water manifold 24, maintaining it at a consistent pressure.

Figure 5:
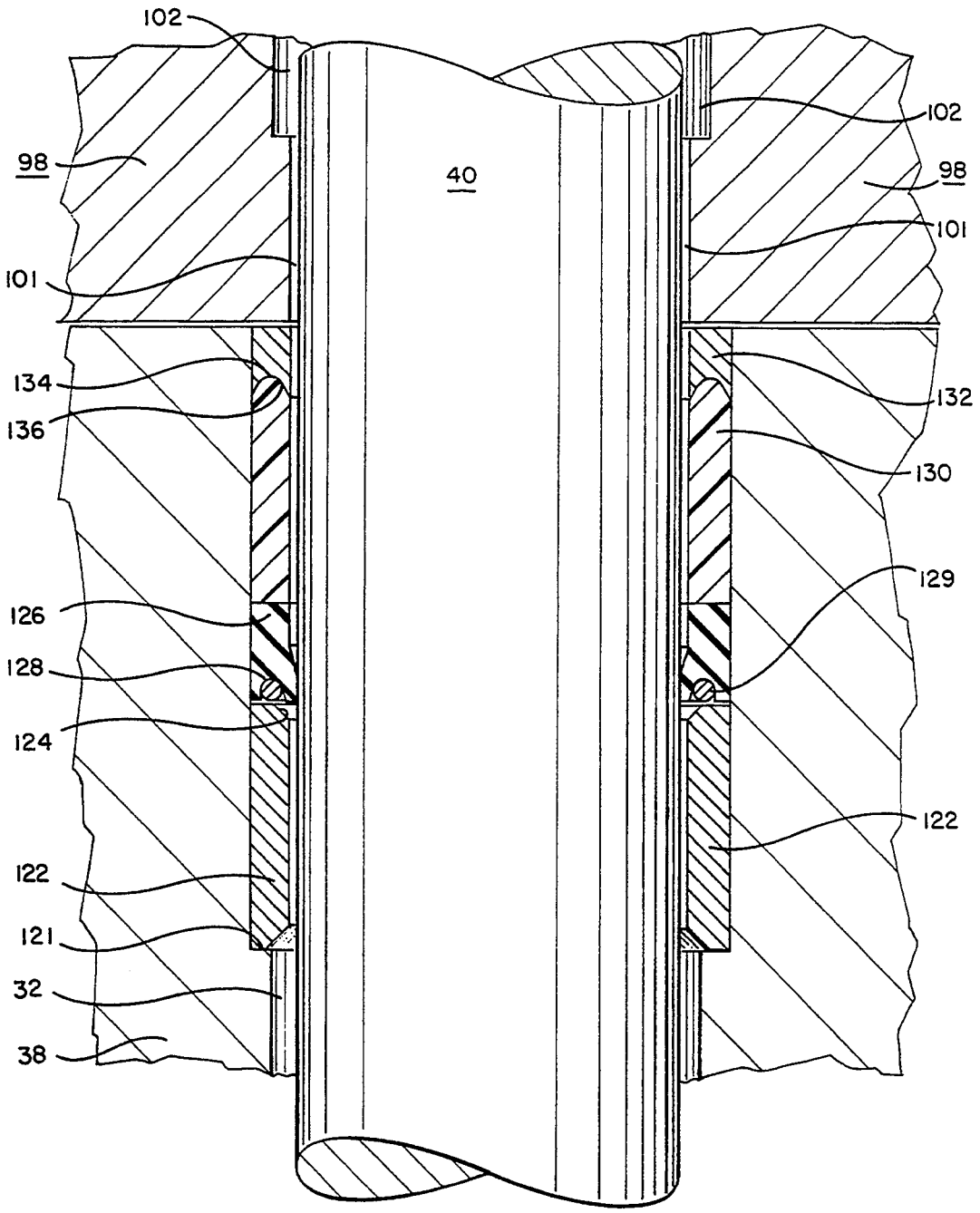
FIG. 5 details an annular seal that isolates the water pressurizing chamber from the middle section if the intensifier.

A unique high pressure water seal 120 depicted in FIG. 5 isolates high pressure chamber 32 from intermediate chamber 83. Seal 120 comprises a series of interlocking collars surrounding plunger 40 immediately beneath lubrication manifold 98. Brass collar 132 interfaces with adjacent lubrication manifold 98 to form a barrier to air and oil intrusion from air chamber 86 and plunger passage 101. Vertical groove 136 in the bottom surface of brass collar 132 cooperates with matching ridge 134 in the top surface of carbon-teflon collar 130. Immediately below teflon collar 130, elastoplastic collar 126 carries in its lower surface groove 128 bearing rubber O-ring 129. This combination of collar 126, groove 128 and O-ring 129 is available commercially as Parker "Polymite" seal catalog no. Z 4651D53. Access bevel 124 in the inner surface of bronze collar 122 below collar 126 allows water from high pressure chamber 32 to reach groove 128 and O-ring 129. The high pressure water causes collar 126 to expand, flaring it against plunger 40 to seal off high pressure chamber 32. Bronze collar 122 abuts ledge 121 adapted to confine seal 120 in place and prevent it from moving with plunger 40.

As mentioned above, high pressure (125 psi) air serves as the power for a control system which directs the driving fluid into and out of driving chambers 75 at appropriate times. Oil input valves 164 and output valves 166 are preferably in-line, full flow, externally torque-operated ball valves with external mechanical handles 165. Suitable input valves 164 and output valves 166 are available as Cat. Nos. KHM 40 F3-1134 and KHM 40 F6-1134 respectively from HYCON Corporation of Bethlehem, Pa. A pneumatic actuator 194 is connected to each output valve 166 to comprise a switching means assembly to control the effluent oil from driving chambers 75. Control air lines 189 and 190 fed by electropneumatic relays 193 and 192 respectively cooperate with opposite ends of the actuators 194 to open and close oil output valves 166 in response to electric signals from relay panel 204. In like fashion, double acting pneumatic actuator 200 is coupled to both input valves 164 and is operated by control air lines 198 and 199 fed by electropneumatic relays 196 and 197 respectively in response to electric signals from relay panel 204. Air actuators 194 and 200 are preferably double acting (reversible), pneumatic/hydraulic, rotary ball valve actuators with manual override. Suitable valves are available as Cat. No. BVA3 from HYCON Corporation of Bethlehem, Pa.

Figure 6:
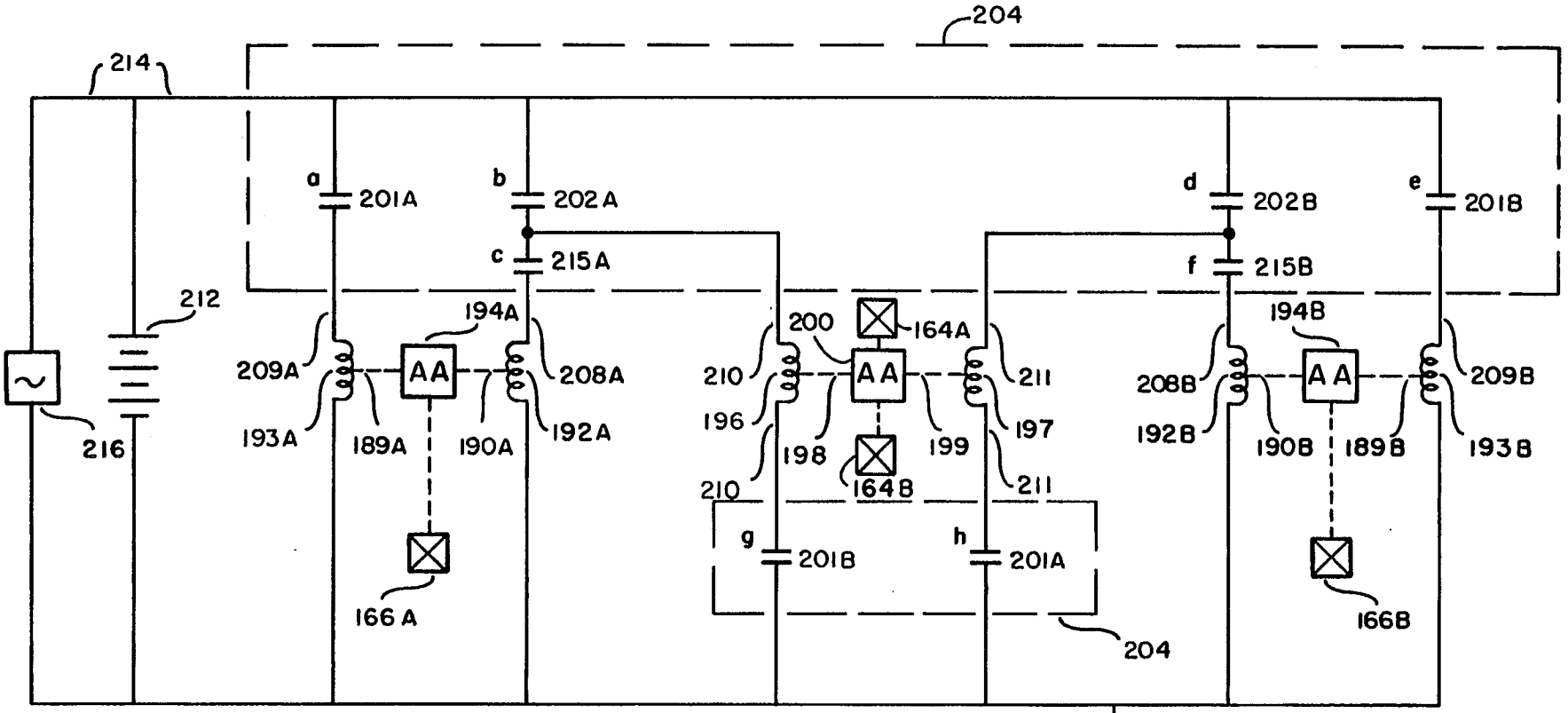
FIG. 6 provides an electrical relay schematic of the control system of the pressurizer system of FIG. 2.
Figure 7:
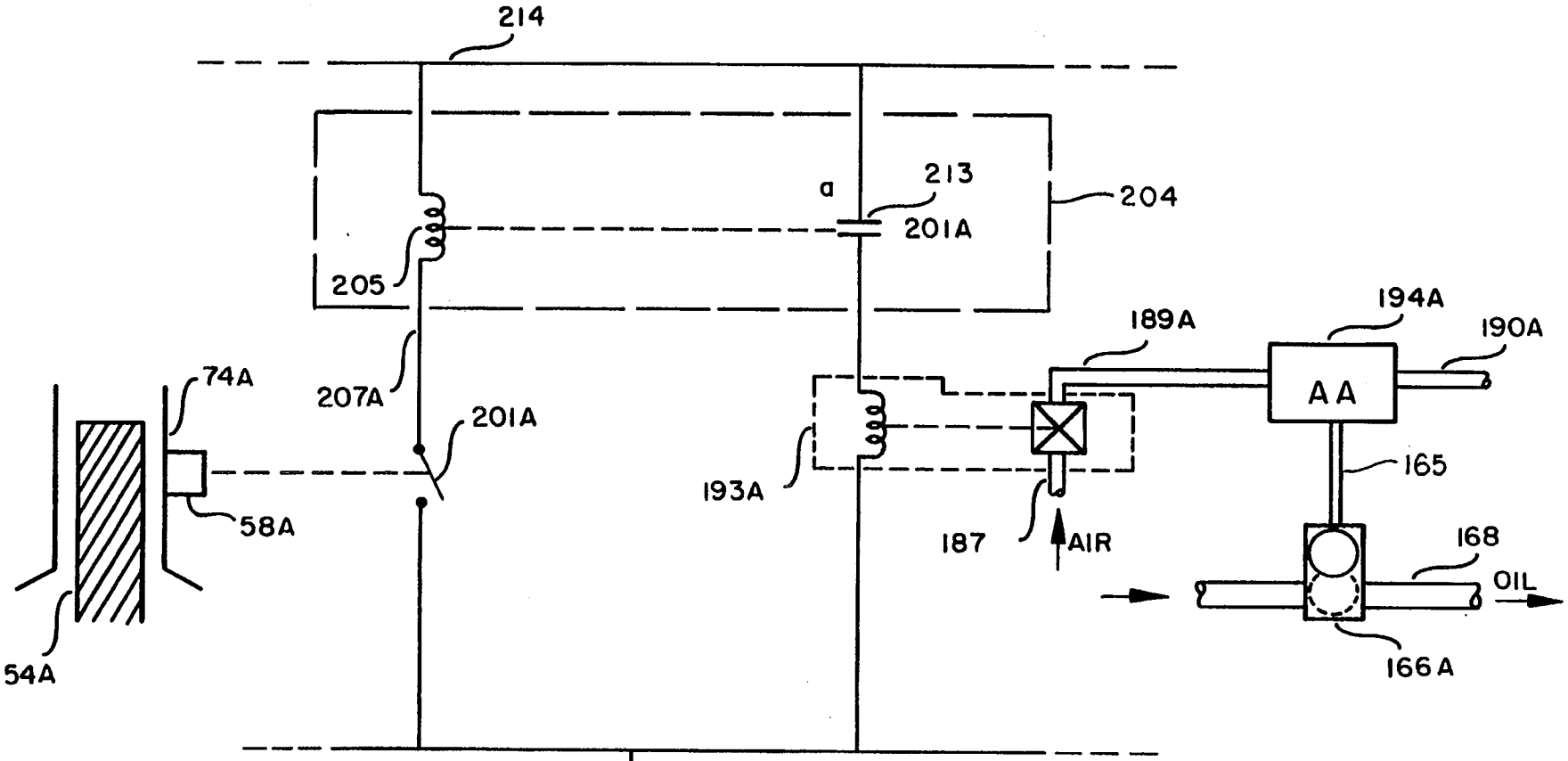
FIG. 7 provides a partial electrical and piping schematic of a single relay and associated devices controlled by the relay.

FIG. 6 shows an electric relay schematic of relay panel 204 and associated devices. Alternator 216 powered by a power takeoff from motor 12 provides direct current (dc) power through leads 214 to relay panel 204 and to battery 212. Within relay panel 204 are relay contacts which transmit this dc power to electropneumatic relays 192, 193, 196 and 197. In keeping with conventional relay diagrams, only the contacts themselves are shown, and the actual operating coils therefor are omitted. The condition under which each coil conducts electricity and thereby closes the contact is shown beside the lettered contact in the schematic. For example, on closing of switch 201A, contact a enables electropneumatic relay 193A to direct air through control air line 189A and to operate actuator 194A. As further detailed in the exemplary circuit diagram of FIG. 7, when magnetic sensing switch 201A (detector 58A shown in seat 74A) detects the proximity of piston 60A (extension 54A thereof shown) to the top end 31A of low pressure chamber 70A, it closes, conducting electricity through lead 207A to a chassis ground at intensifier 30A. This operates relay coil 205 to close contact 213 (labeled a) to transmit dc power to pneumatic relay 193A. Thus, the closing condition of contact a is indicated as 201A. Contact a directs power to the solenoid coil of pneumatic relay 193A which in turn opens its solenoid controlled valve to permit air from line 187 to enter line 189A. This air from line 189A operates air actuator 194A which switches ball valve 166A to cease permitting the passage of oil from driving chamber 75A into return line 168. Per conventional relay schematics, a plurality of closing coils may operate upon the closing of one switch, closing more than one relay contact, as seen in FIG. 6 for switch 201A with contacts a and h.

Contact h must close to permit actuator 200 to open valve 164A and simultaneously close valve 164B, but this cannot be permitted until piston 60A reaches its beginning position. Hence, contact 201A enables this operation, but does not trigger it until switch 202B indicates that piston 60B is nearing the end of its power stroke. To accomplish this, cam-operated switches 215A and 215B alternately detect completed operation of air actuator 200 and close contacts c and f respectively, permitting pneumatic relays 192 to operate air actuators 194 to re-open valves 166 only after air actuator 200 has finished switching driving fluid input from valve 164A to 164B and vice versa before opening output valves 166A and 166B respectively.

In operation, as piston 60A nears the top of its return stroke, magnetic switch 201A operates, closing contacts a and h. This immediately results in pneumatic relay 193A starting to close output valve 166A by switching actuator 194A. This also enables pneumatic relay 197 to begin switching actuator 200 once magnetic switch 202B closes contact d, indicating that piston 60B in nearing the end of its power stroke. This occurs slightly before piston 60B completes its power stroke because magnetic switch 202B actually detects the arrival of impact collar 116B. Thus, pneumatic relay 197 begins switching actuator 200 to close input valve 164B and simultaneously to open input valve 164A, thereby beginning piston 60A's power stroke just as piston 60B finishes its power stroke. Accordingly, a smooth shift of driving fluid from one intensifier 30 to the other occurs, assuring that continuous pressure is exerted by one plunger 40 or the other to maintain a steady pressure in water manifold 24. After cam-operated switch 215B detects completed operation of air actuator 200, it closes contact f, immediately causing pneumatic relay 192B to open output valve 166B using actuator 194B. This permits piston 60B to be returned to top end 31B of low pressure chamber 70B and permits the oil to be expelled from driving chamber 75B as piston 60A goes through its power stroke.

When magnetic sensing switch 201B detects arrival of piston 60B, it closes, enabling pneumatic relay 196 through contact g and closing contact e to immediately cause pneumatic relay 193B to close output valve 166B by reversing the air pressure to actuator 194B. As discussed above, this causes air pressure to rise in the air system, including return chamber 77A, thereby beginning a cushioning and slowing process for piston 60A. When magnetic sensing switch 202A detects arrival of impact collar 116A, indicating that piston 60A is nearing completion of its power stroke, it closes contact b, immediately causing pneumatic relay 196 to begin closing input valve 164A and opening input valve 164B by switching actuator 200. Oil enters driving chamber 75B, causing piston 60B to begin its power stroke. After cam-operated switch 215A detects completed operation of air actuator 200, it closes contact c, immediately causing pneumatic relay 192A to open output valve 166A using actuator 194A. This permits piston 60A to return to top end 31A of low pressure chamber 70A and forces the oil out of driving chamber 75A. As piston 60A reaches top end 31A, magnetic sensing switch 201A detects its arrival, closing contacts a and h to begin the cycle again.

As oil is expelled from driving chamber 75 of either intensifier 30, it initially flows vertically upward through top end 31 and out fitting 76 to enter return line 168. In proceeding toward radiator 174 located at the opposite end of trailer 2, it flows vertically downward from fitting 76 toward accumulator 170 and filters 172. Once piston 60 completes its return stroke, pressure on the oil is relieved. Left to fall under its own weight, the oil will continue to drain from driving chamber 75 and fitting 76, thus causing cavitation, before input valve 164 opens to begin a new power stroke. Capillary line 167 prevents such cavitation by keeping driving chamber 75 filled with oil under pressure from the power stroke of the other intensifier 30. A suitable capillary line 167 can be a one-fourth (¼") inch inside diameter (i.d.) line bridging directly between two (2") inch i.d. fittings 76A and 76B between intensifiers 30A and 30B respectively. As each piston 60 is driven through its power stroke, a slight amount of the driving oil is siphoned off by capillary line 167 to maintain sufficient pressure in the other driving chamber 75 to prevent cavitation. The pressure loss to the power stroke of the operating piston 60 is insignificant.

The relative diameters of piston 60 and plunger 40, together with the driving fluid pressure, determine the output pressure of the working fluid. Preferably, piston 60 is ten (10) inches in diameter while plunger 40 is preferably 2⅝ inches in diameter, for a square area ratio of approximately 14.6 to 1. This results in an output pressure of 36,500 psi when the driving fluid is 2500 psi. Obviously, this implies a tightly constricted output through outlet 37, water manifold 24, distributor 25 and tool 26. Preferably, tool 26 comprises a wand having a nozzle aperture of approximately 0.020", creating a very narrow high pressure stream which can be directed precisely at work site 4 for precision cutting and cleaning. Accounting for losses in distributor 25 and some pressure reduction at the nozzle, the system has been demonstrated to reliably maintain in excess of 30,000 psi during all portions of the power and return strokes of intensifiers 30.

Hydraulic pressurizer 10 described in the foregoing discussion operates at an unusually low reciprocation frequency, reducing wear on moving parts, and requiring infrequent maintenance and repair in contrast to pressurizers operating at faster reciprocation rates. This in turn increases reliability. Each intensifier 30 produces approximately six (6) power strokes per minute, each having a duration of approximately five (5) seconds, while each return stroke requires approximately two and one half (2.5) seconds. This is achieved by the large displacement of working chamber 32. Each plunger 60 displaces approximately 97 cubic inches (c.i.) with each power stroke, or 582 c.i., 1164 cu. in. per minute, or approximately 5 gal. per minute, being displaced by pressurizer 10.

Such a narrow stream of water (0.020") pressurized in excess of 30,000 psi when it exits the nozzle is capable of cutting half (½") inch thick steel plate or concrete six (6") inches thick, when a small amount of sand or grit is introduced immediately downstream the nozzle by convenient means, and achieves a thin, clean cut rivaling that possible with acetylene cutting torches. Without sand or grit, such a stream is capable of removing highly adherant paint or contaminants. Moreover, the pressurizer 10 performs these operations in a non-combustion operation which renders the cutting and cleaning operations safe in the presence of flammable volatile liquids and gasses common in industrial settings.

While the invention has been particularly shown and described with reference to a preferred embodiment, it will be understood by those skilled in the art that various changes in form and detail may be made therein without departing from the spirit and scope of the invention. For example, pressurizer 10 has been shown mounted on trailer 2 for transportation to remote site 4. Pressurizer 10 could alternatively be mounted on skids or stationary, where cutting work is passed in front of the nozzle (e.g., on conveyor belts) without the need for an operator to handle tool 26. In such an installation, fixed power sources could lend efficiencies in contrast to the portable power source made available here in the form of motor 12. As another example, though the control system has been shown using electromechanical relays, the control circuits could easily be achieved with semiconductor electronic circuitry. As another example, different piston 60 to plunger 40 ratios could be employed to vary output pressures and reciprocating frequencies as appropriate for the application. With appropriate adjustments in displacement volumes, multiple tools 26 could be supplied by a single pressurizer 10.

I claim:

1. An intensifier for pressurizing a working fluid, the intensifier comprising a low pressure chamber having a top end and a bottom end longitudinally opposite the top end;

a high pressure chamber coaxial with and coupled to the bottom end of the low pressure chamber;

a piston adapted to reciprocate longitudinally within the low pressure chamber;

a plunger having a piston end and a pressure end, the plunger coupled by its piston end to the piston and having its pressure end extending into the high pressure chamber;

a first collar concentric the plunger and coupled to the piston;

a spring concentric the plunger and coupled to the first collar opposite the piston;

a second collar concentric the plunger and coupled to the spring opposite the first collar; and a seat concentric the plunger and coupled to the bottom of the low pressure chamber, the seat adapted to receive internally the second collar and the spring;

driving means for directing a driving fluid into and out of a space between the piston and the top end of the low pressure chamber;

return means for directing a return fluid into and out of a space between the piston and the bottom end of the low pressure chamber; and charging means for directing the working fluid into and out of the high pressure chamber.

2. An intensifier for pressurizing a working fluid, the intensifier comprising a low pressure chamber having a top end and a bottom end longitudinally opposite the top end;

a high pressure chamber coaxial with and coupled to the bottom end of the low pressure chamber;

a piston adapted to reciprocate longitudinally within the low pressure chamber;

a plunger having a piston end and a pressure end, the plunger coupled by its piston end to the piston and having its pressure end extending into the high pressure chamber;

driving means, for directing a driving fluid into and out of a space between the piston and the top end of the low pressure chamber, the driving means having a reservoir;

a pump coupled to the reservoir;

input valve means coupled between the pump and the low pressure chamber for controlling pressurized oil input to the low pressure chamber;

output valve means coupled between the low pressure chamber and the reservoir for controlling return oil emitted from the low pressure chamber; and control means, for controlling the input valve means and the output valve means, the control means having first sensing means for detecting proximity of the piston to the top end of the low pressure chamber;

second sensing means for detecting proximity of the piston to the bottom end of the low pressure chamber;

an air operated actuator coupled to each of the valve means;

electropneumatic relays coupled to the actuators for directing air into the actuators to operate the valve means; and electric controllers for directing electric power to the relays;

return means for directing a return fluid into and out of a space between the piston and the bottom end of the low pressure chamber;

cushioning means for cushioning an impact between the piston and the bottom end of the low pressure chamber; and charging means for directing the working fluid into and out of the high pressure chamber.

3. The intensifier according to claim 2 wherein each sensing means comprises:

a magnetic proximity switch adapted to complete an electric circuit upon detection of the piston.

4. An apparatus for providing a pressurized working fluid, the apparatus comprising a plurality of intensifiers, each intensifier having a low pressure chamber further having a driving chamber adapted to receive internally a driving fluid;

a return chamber adapted to receive internally a return fluid; and a piston separating the driving chamber and the return chamber, the piston adapted to reciprocate longitudinally within the low pressure chamber in response to changes in pressure in the driving and return chambers;

a working chamber adapted to receive a working fluid; and a plunger coupled to the piston and interconnecting the low pressure chamber and the working chamber, the plunger reciprocating in step with the piston for transferring pressure between the working fluid and the driving fluid;

driving means coupled to the driving chamber for providing the driving fluid to the driving chambers;

return means coupled to the return chamber for providing the return fluid to the return chambers;

charging means coupled to the working chamber for directing the working fluid into the working chambers of the intensifiers;

manifold means coupled to the working chamber for receiving pressurized working fluid from the working chamber;

control means for diverting driving fluid into and out of the driving chamber of each intensifier in turn, the control means having an input valve coupled between the driving means and each driving chamber;

an output valve coupled between each driving chamber and a reservoir;

first sensing means for detecting proximity of the piston at the driving chamber end of the low pressure chamber and for emitting a signal in response thereto;

second sensing means for detecting proximity of the piston at the return chamber end of the low pressure chamber and emitting a signal in response thereto;

a first air-operated actuator coupled to the input valve;

a second air-operated actuator coupled to the output valve;

an electropneumatic relay coupled to each of the first and second air-operated actuators;

a plurality of electric controllers for directing electric power to the electropneumatic relays; and relay means for receiving signals from the first and second sensing means and transmitting signals to the electric controllers in response thereto.

5. An apparatus for providing a pressurized working fluid, the apparatus comprising a plurality of intensifiers, each intensifier having a low pressure chamber further having a driving chamber adapted to receive internally a driving fluid;

a return chamber adapted to receive internally a return fluid; and a piston separating the driving chamber and the return chamber, the piston adapted to reciprocate longitudinally within the low pressure chamber in response to changes in pressure in the driving and return chambers;

a working chamber adapted to receive a working fluid; and a plunger coupled to the piston and interconnecting the low pressure chamber and the working chamber, the plunger reciprocating in step with the piston for transferring pressure between the working fluid and the driving fluid;

driving means coupled to the driving chamber for providing the driving fluid to the driving chambers;

return means coupled to the return chamber for providing the return fluid to the return chambers;

charging means coupled to the working chamber for directing the working fluid into the working chambers of the intensifiers;

manifold means coupled to the working chamber for receiving pressurized working fluid from the working chamber;

control means for diverting driving fluid into and out of the driving chamber of each intensifier in turn, the control means having an input valve coupled between the driving means and each driving chamber;

an output valve coupled between each driving chamber and a reservoir;

a first magnetic proximity switch mounted near the driving chamber end of the low pressure chamber and adapted to complete a first electric circuit upon detecting proximity of the piston;

a second magnetic proximity switch mounted near the return chamber end of the low pressure chamber and adapted to complete a second electric circuit upon detecting proximity of the piston;

first switching means for opening the input valve and closing the output valve in response to a first signal;

second switching means for closing the input valve and opening the output valve in response to a second signal; and relay means for detecting completion of the first and second circuits and relaying the first and second signals to the first and second switching means in response thereto.

6. An apparatus for pressurizing a working fluid, the apparatus comprising a plurality of intensifiers, each intensifier including a working chamber for receiving the working fluid;

a low pressure chamber coaxial with and longitudinally coupled to the working chamber and including a driving chamber adapted to receive a driving fluid; and a return chamber adapted to receive a return fluid;

a piston separating the driving chamber from the return chamber, the piston adapted to reciprocate longitudinally within the low pressure chamber in response to pressure changes in the driving and return fluids to create periodic power strokes alternating with power strokes of other intensifiers; and a plunger coupled to the piston and extending into the working chamber, the plunger adapted to transfer power from the driving fluid to the working fluid during each power stroke;

driving means coupled to each driving chamber for selectively supplying the driving fluid thereto from a driving fluid source;

return means coupled to each return chamber for providing the return fluid to the return chambers between driving strokes;

charging means for directing the working fluid into the working chamber;

manifold means for receiving pressurized working fluid from the working chamber;

a return fluid system coupled between the return chambers of the intensifiers and including at least one fluid line coupling together the return chambers;

a reservoir coupled to the line;

a fluid pressure regulator coupled to the line and adapted to supply the return fluid at a predetermined pressure; and confining means for alternately confining the return fluid within all but one of the intensifiers, thereby cushioning the piston of the remaining intensifier during its power stroke.

7. The apparatus of claim 6 wherein the confining means comprises input valves between the driving chambers of each intensifier and the driving means;

output valves coupled to the driving chambers;

proximity sensing means for providing a signal upon sensing proximity of the piston to each end of its power stroke;

control means for controlling the input and output valves in response to signals from the proximity sensing means.

8. An apparatus for pressurizing a working fluid, the apparatus comprising a plurality of intensifiers, each intensifier including a working chamber for receiving the working fluid;

a low pressure chamber coaxial with and longitudinally coupled to the working chamber and including a driving chamber adapted to receive a driving fluid; and a return chamber adapted to receive a return fluid;

a piston separating the driving chamber from the return chamber, the piston adapted to reciprocate longitudinally within the low pressure chamber in response to pressure changes in the driving and return fluids to create periodic power strokes alternating with power strokes of other intensifiers; and a plunger coupled to the piston and extending into the working chamber, the plunger adapted to transfer power from the driving fluid to the working fluid during each power stroke;

driving means coupled to each driving chamber for selectively supplying the driving fluid thereto from a driving fluid source;

return means coupled to each return chamber for providing the return fluid to the return chambers between driving strokes;

charging means for directing the working fluid into the working chamber;

manifold means for receiving pressurized working fluid from the working chamber; and a pneumatic return fluid system including the return chambers of each intensifier;

pneumatic lines coupling together the return chambers;

a pneumatic reservoir coupled to the lines;

a pneumatic regulator coupled to the lines and adapted to supply the return fluid at a predetermined pressure; and confining means for confining the return fluid within a first intensifier during the power stroke of a second intensifier, thereby reducing a total volume of the return fluid system, raising the return fluid pressure and cushioning the power stroke of the piston of the second intensifier.

9. The apparatus of claim 8 wherein the confining means comprises input valves between the driving chambers of each intensifier and the driving means;

output valves coupled to the driving chambers;

proximity sensing means for sensing proximity of the piston to each end of its power stroke;

control means for controlling the input and output valves by sequentially closing the output valve and opening the input valve of a first intensifier, thereby admitting and confining driving fluid to the driving chamber of the first intensifier and initiating a power stroke, opening the output valve and closing the input valve of a second intensifier while the driving fluid forces return fluid out of the return chamber of the first intensifier and into the return chamber of a second intensifier, causing the piston of the second intensifier to move toward its driving chamber and expelling the driving fluid therein until the proximity sensing means senses the second piston nearing the top of its driving chamber, the control means thereupon closing the output valve of the second intensifier to confine the return fluid.

10. Method for cushioning fluid intensifier piston power strokes, the method comprising providing a plurality of fluid intensifiers, each intensifier having a low pressure chamber coupled longitudinally to a working chamber, a piston reciprocating within and longitudinally dividing the low pressure chamber into a return chamber and a driving chamber, the driving chamber adapted to receive a driving fluid, the intensifier further having a plunger coupled to the piston and extending into the working chamber for delivering power from the driving fluid to a working fluid within the working chamber;

providing driving means coupled to each driving chamber, the driving means including driving fluid pressurizing means;

a driving fluid reservoir;

input valve means coupled between the driving fluid pressurizing means and the driving chamber of each intensifier; and output valve means coupled between the driving chamber of each intensifier and the reservoir;

providing return means coupled to each return chamber, the return means including a pneumatic reservoir coupled to each return chamber;

pneumatic pressurizing means coupled to the return chamber and adapted to provide pressurized pneumatic fluid to each return chamber; then repeating the steps of opening the input valve means on a first intensifier to divert driving fluid into the driving chamber thereof while simultaneously closing the input valve means on a second intensifier; then opening the output valve means on the second intensifier to permit driving fluid contained therein to escape to the reservoir; then waiting while the driving fluid entering the first intensifier drives the piston therein through a power stroke while a portion of the return fluid within the return chamber thereof is forced out of that return chamber, into the pneumatic reservoir and into the return chamber of the second intensifier, thereby causing the piston of the second intensifier to move toward the driving chamber thereof, expelling the driving fluid therein through the output valve means thereof; then closing the output valve means on the second intensifier and trapping the pneumatic fluid between the pistons of the first and second intensifiers, increasing pressure of the pneumatic fluid and cushioning the drive stroke of the piston of the first intensifier; then closing the input valve means of the first intensifier while simultaneously opening the input valve means of the second intensifier, thereby beginning a power stroke of the second intensifier piston; then opening the output valve means of the first intensifier, permitting the driving fluid to be expelled from the driving chamber of the first intensifier during the power stroke of the second intensifier; and then closing the output valve means on a first intensifier to cushion the power stroke of the second intensifier.

11. An intensifier for pressurizing a working fluid, the intensifier comprising a low pressure chamber having a top end and a bottom end longitudinally opposite the top end;

a high pressure chamber coaxial with and coupled to the bottom end of the low pressure chamber;

a piston adapted to reciprocate longitudinally within the low pressure chamber;

a plunger having a piston end and a pressure end, the plunger coupled by its piston end to the piston and having its pressure end extending into the high pressure chamber;

driving means, for directing a driving fluid into and out of a space between the piston and the top end of the low pressure chamber, the driving means having a reservoir;

a pump coupled to the reservoir;

an input ball valve coupled between the pump and the low pressure chamber, the input ball valve having a first external mechanical handle;

an output ball valve coupled between the low pressure chamber and the reservoir, the output ball valve having a second external mechanical handle;

two double-acting actuator switches, one each coupled to one of the first and second external mechanical handles;

control means coupled to the double-acting actuator switches for controlling the input and output ball valves;

return means for directing a return fluid into and out of a space between the piston and the bottom end of the low pressure chamber;

cushioning means for cushioning an impact between the piston and the bottom end of the low pressure chamber; and charging means for directing the working fluid into and out of the high pressure chamber.

* * * * *